US011077999B2

(12) United States Patent
Bomba et al.

(10) Patent No.: US 11,077,999 B2
(45) Date of Patent: Aug. 3, 2021

(54) WRAPPING TEARING DEVICE

(71) Applicant: BBB S.r.l., Cassano delle Murge (IT)

(72) Inventors: Gabriele Bomba, Milan (IT); Vincenzo Battista, Cassano delle Murge (IT)

(73) Assignee: BBB S.r.l., Cassano Delle Murge (IT)

( * ) Notice: Subject to any disclaimer, the term of this patent is extended or adjusted under 35 U.S.C. 154(b) by 53 days.

(21) Appl. No.: 14/439,821

(22) PCT Filed: Oct. 30, 2013

(86) PCT No.: PCT/IB2013/059797
§ 371 (c)(1),
(2) Date: Apr. 30, 2015

(87) PCT Pub. No.: WO2014/068503
PCT Pub. Date: May 8, 2014

(65) Prior Publication Data

US 2015/0314938 A1 Nov. 5, 2015

(30) Foreign Application Priority Data

Oct. 30, 2012 (IT) ..... MI2012A001849

(51) Int. Cl.

| | |
|---|---|
| ***B65D 71/08*** | (2006.01) |
| ***B65D 65/14*** | (2006.01) |
| ***B65D 75/28*** | (2006.01) |
| ***B65D 75/56*** | (2006.01) |
| ***B65D 75/66*** | (2006.01) |
| ***B65D 77/30*** | (2006.01) |

(52) U.S. Cl.
CPC ..... *B65D 71/08* (2013.01); *B65D 65/14* (2013.01); *B65D 75/28* (2013.01); *B65D 75/56* (2013.01); *B65D 75/66* (2013.01); *B65D 77/30* (2013.01); *B65D 2575/586* (2013.01)

(58) Field of Classification Search
CPC .... B65D 75/66; Y10S 229/924; Y10T 225/30
See application file for complete search history.

(56) References Cited

U.S. PATENT DOCUMENTS 1,587,280 A * 6/1926 Burke ..... B65D 75/58 229/122.2
2,984,573 A * 5/1961 Smith ..... B65D 75/08 53/415

(Continued)

FOREIGN PATENT DOCUMENTS

DE 20 2008 015097 1/2009
WO 87/00149 1/1987

*Primary Examiner* — Shawn M Braden
(74) *Attorney, Agent, or Firm* — Bay State IP, LLC

(57) ABSTRACT

A tearing device to be applied to a complete package (1, 2) is disclosed, consisting of an adhesive label having a base layer (3) provided with an adhesive portion and a terminal portion (32, 33, 34, 32', 33') acting as gripping edge for imparting a manual traction, the label being so arranged as to determine at least two points of localised application of the stress, or a point of application of the stress and a point of reaction to the stress, very close to each other, upon applying a traction on said terminal portion. A weakening line or a preferred-rupture line (4, 4') may be provided, with the base layer being made of a material having an ultimate tensile strength higher than that of the wrapping sheath and a much lower tensile elongation than that of the wrapping sheath.

12 Claims, 9 Drawing Sheets

(56) References Cited

U.S. PATENT DOCUMENTS

| | | | | |
|---|---|---|---|---|
| 3,201,258 | A * | 8/1965 | Louis | B65D 75/66 206/449 |
| 3,301,687 | A * | 1/1967 | Davy | B65D 75/66 229/87.05 |
| 2002/0157980 | A1 | 10/2002 | Sheehan | |
| 2006/0113361 | A1 * | 6/2006 | Aeschlimann | B65D 75/66 229/87.05 |
| 2008/0041907 | A1 | 2/2008 | Calabretta | |

* cited by examiner

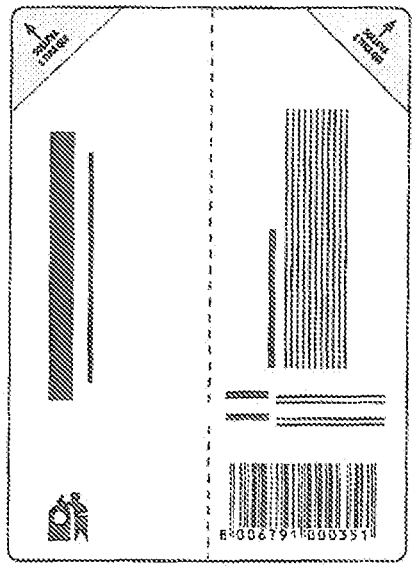
Fig. 9
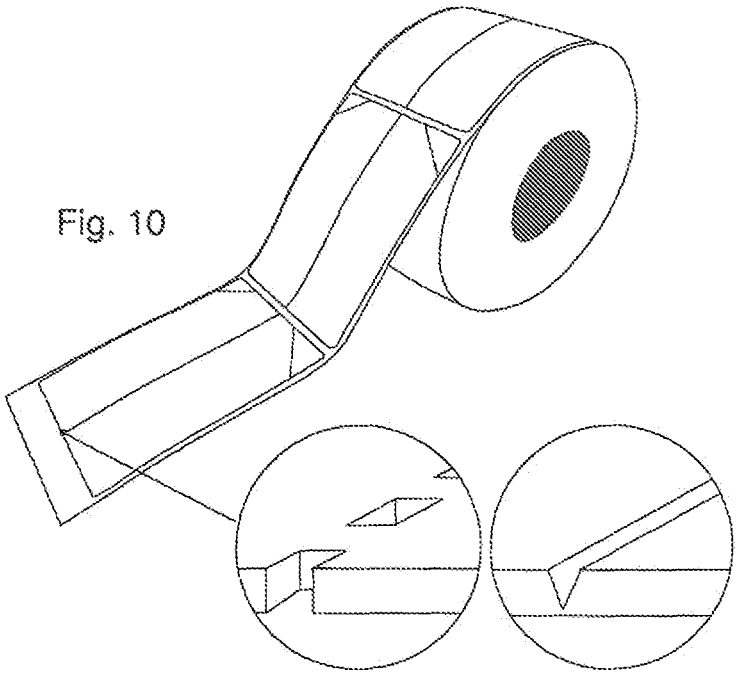
Fig. 10
Fig. 10a Fig. 10b

WRAPPING TEARING DEVICE

CROSS REFERENCE TO RELATED APPLICATION

This application is for entry into the U.S. National Phase under § 371 for International Application No. PCT/IB2013/059797 having an international filing date of Oct. 30, 2013, and from which priority is claimed under all applicable sections of Title of the United States Code including, but not limited to, Sections 120, 363, and 365(c), and which in turn claims priority under 35 USC 119 to Italian Patent Application No. MI2012A001849 filed on Oct. 30, 2012.

FIELD OF THE INVENTION

The present invention relates to a device for the tearing of primary, secondary or tertiary wrappings.

BACKGROUND ART

As known, in the wrapping field, a number of methods and of different types of materials is used.

In general, products are contained within wrappings which by law are defined as primary for containing the sales unit, as secondary for grouping in the sales point multiple sales units and as tertiary for easing transport and protecting the integrity of the goods during transport and logistics.

In the following, the term wrapping will be used as a synonym and equivalent to the term package, even though normally a package is understood to be different at least from tertiary wrappings.

Wrappings generally consist of whatever material meant to contain and protect the goods useful for delivering finished products or raw materials from the manufacturer to the consumer or user. In particular, the most common materials for the manufacturing of wrappings are paper, plastic and metal typically in sheets or films sufficiently thick as to guarantee a suitable level of protection of the contents, but also sufficiently thin as to minimise the cost of the wrapping itself.

In order to allow access to the product contained in the package it is necessary to open the same. For this reason, different ways and techniques are provided. In general the package may provide predefined or undefined openings; in the former case, the user may perform the opening procedure which provides for example the removal of a closing device or the severing of wrapping flaps made suitably integral after product insertion.

Vice versa, in simpler and cheaper packaging techniques, typically devoid of closing devices, the user must provide to open again the closing flaps of the package or he/she must provide to the direct tearing of the material which the wrapping is made of. Sometimes it is also necessary to use cutting tools for the tearing of said materials, with the danger of improperly coming into contact with the packaged product damaging it, contaminating it or causing unsuitable, annoying or even dangerous leaks of the product contained therein.

In most cases the cheapest and most widespread wrappings consist of plastic film or thin sheets of paper material. In some cases, especially when it is necessary to pack food products which must be exhibited, a tray closed above by a thin plastic film or membrane is used. This method of packaging also has the advantage of being extremely inexpensive and fast to perform and is hence highly suited to the packaging of large amounts of products also for short periods of time. An application field in which large use of such mode is made is that of mass-distribution food packaging, in particular for fresh foods (meats, cheeses, . . . ). As known, foods are typically laid in foamed-polystyrene trays and then covered with plastic stretching film. The film is wound around the tray (or other container) and hence tensioned well on the contents, so as to firmly retain them inside. It is desirable for the film to be well taut, also because this eases the application of self-adhesive labels, typically bearing the features of the contents, such as weight, best before date and price.

The stretching film is nevertheless used for packaging a number of types of products also in other product categories. Other known packages provide that the upper closing film is heat-welded to the edge of the semi-rigid container tray. Furthermore, other types of packages are in the shape of envelopes of plastic/paper material, semi-rigid boxes and simple sheaths of heat-shrinking film which adhere tightly to the product.

The common factor of all these packages—as of many others in which it is not wished to provide a suitable closing/opening device—is the need to tear the closing wall or membrane in order to be able to open the package and access the product. As mentioned above, however, it is common experience that such opening is not at all easy for various reasons, in particular due to the specific properties of the packaging sheaths, especially tenacity; a stretching film, for example, tolerates a lengthening of up to 1000% before rupturing. Moreover, when these sheaths are taut (as in the case of the closing film on a tray) they have no gripping points for starting tearing: the typical approach is that of pinching said membrane with one's fingers in two points and then pulling to start tearing. This procedure, however, is not always effective, in particular because the film membrane may be wet, adhering to the lower layers, or simply due to the high elastic features; moreover, the consumer's poor dexterity or motor difficulties and difficulties in perceiving the thin, clear membrane make this operation unpleasant for most consumers, who must necessarily resort to cutting tools.

With reference to the gripping problem, the following must also be observed. The grip which may be imparted between the two pairs of opposite fingers of one's hands always occurs in discrete areas mutually spaced-apart by a certain measure, for example 3-6 mm. That depends on the fact that the fleshy parts of the finger tips are soft, yielding and rounded and it is hence not possible to pinch two points of sheath mutually separated by a sufficient small distance.

The mechanics of the rupture is due to a physical phenomenon linked to the exceeding of a certain percentage elongation where the material arrives at the limit of structural resistance. The consequence of this behaviour of the materials is that the overall length to which the user must bring the gripping points of material proportionally depends on the length of material initially found between the two gripping points. In practice, the smaller the starting portion material $L_0$, the sooner the percentage elongation rupture value is obtained in terms of lengthening path. On more fragile materials, such as paper for example, the rupture is obtained with very small percentage elongation, but more ductile materials such as plastic can reach also elongation values of up to 1000%.

That represents one of the main reasons at the base of the tearing difficulty of packaging sheaths, which would be an increasingly smaller as $L_0$ become shorter.

Similar problems are detected with many types of packages, such as cardboard boxes, plastic envelopes, and so on.

In some cases it has already been provided to arrange tearing tabs or ribbons, integral with the wrapping material, which may be easily gripped with the fingers of one's hand to impart a tearing force. The removal of the tearing ribbon interrupts the continuity of the wrapping or of the sheath and it hence allows to gain access to the inside of the package. Typically these tearing ribbons must be defined and manufactured together with the same packaging sheath, which they are an integral part of: that implies construction problems and configuration constraints, because the ribbon must always be located in a position suitable to be reached and effectively perform the opening action thereof.

A package of this type is illustrated in DE202008015097U. The package, upon manufacturing, is provided with an additional device, provided with intrinsic rigidity and with a precut line and applied in correspondence of a precut of the package, by which it is possible to impart a significant tearing stress either acting on a corner of the package or on a gripping recess.

US2002157980 discloses a further package which integrates a tearing-ribbon system, which in turn may act as a handle for the package. The tearing-ribbon system has a complex configuration and is hence mounted on the wrapping film during the manufacturing step, which implies additional burden both to the wrapping material manufacturer, and to the packager for the correct positioning of the film on the product.

In the prior art it has also already been suggested to use simple adhesive tapes to be applied externally to the package to be able to conveniently impart a tearing traction. These devices may be advantageously applied to the package after the complete forming thereof. However, in the light also of the features of the "pressure adhesives" of current adhesive tapes, the stress which may be imparted is rather modest and the effectiveness of the same is not satisfactory.

An very simple example is disclosed in US 2008041907, wherein a partly adhesive tape is provided, with an adhesive-less portion which may be gripped by the fingers of one's hand. However, this solution is ineffective for most wrappings, because the sole adhesive is unable to withstand the peeling force which is imparted between the adhesive-less part and the part adhering to the wrapping: the maximum stress which may be imparted to the wrapping is hence often ineffective to cause the tearing thereof.

WO8700149 discloses a tearing device consisting of an adhesive tape folded and composed of two portions (tabs) which may be gripped by the fingers of one's hand. In this case, the tearing of the package is possible due to the provision of notches in the underlying wrapping. The two traction tabs are substantially perpendicular to the wrapping sheet, hence the opening action occurs substantially by rupture of the underlying precut lines, but it would not otherwise be possible to tear the wrapping with an adhesive tape which has a lower traction resistance than that of the wrapping.

In the light of these little-effective prior-art examples, the Applicant has instead realised that the shape of the adhesive device must be optimised to be able to produce useful tearing stresses suited to severe even a continuous wrapping.

SUMMARY OF THE INVENTION

The object of the present invention is hence that of solving the drawbacks set forth above, providing a device for the tearing of the wrapping which is extremely inexpensive, does not interfere with the manufacturing processes of the package/wrapping and which makes it easy for the user to open the package. In particular, it is meant to provide an adhesive device, applicable to the outside of a sealed package, which is configured so as to impart a tearing traction effective for the opening of the wrapping.

Such an object is achieved through the features described in essential terms in the attached claims.

In particular a label conceived and configured to remarkably ease the opening of packages is provided, since it is specifically conceived for distributing the stresses across the label structure to the material to be torn or to the package wall.

The label configuration, preferably provided with a precut line and with a non-adhesive portion, simultaneously achieves:

- a grip structured for imparting the opening stress;
- the ability to direct the stress along a preferred rupture line, guiding and boosting the tearing of the thin film;
- the identification of label areas which, after tearing, remain untorn in a controlled way; that allows to avoid fractures or tears in the areas meant for the communication of essential data to the consumer, such as best-before-by dates, which might otherwise become unreadable after opening.

BRIEF DESCRIPTION OF THE DRAWINGS

Further features and advantages of the invention will in any case be more evident from the following detailed description of a preferred embodiment, given purely by way of a non-limiting example and illustrated in the attached drawings, wherein:

FIG. 6 is a perspective view of a further exemplifying package, provided with an adhesive label, of which

FIG. 9 is a top plan view of a further embodiment of the invention, in the shape of a label displaying some packaging/pricing data;

FIG. 10 is a perspective view of a roll comprising a plurality of adhesive labels according to the invention, of which FIGS. 10A and 10B represent enlarged perspective views of two possible variants of a preferred-rupture line used;

DETAILED DESCRIPTION OF PREFERRED EMBODIMENTS

A package, as mentioned, may take up various shapes. Typically it has a series of thin walls, mutually connected so as define a fillable and then sealable container (not necessarily air-proof or water-proof, but at least suited not to allow the relative contents to leak). Exemplifyingly, reference will be made in the following to some types of packages which have thin sheaths of material tearable with a reduced force (plastic film, paper, cardboard, . . . ): nothing prevents, however, from being able to extend the teachings provided here, through a suitable sizing and choice of materials, also to other packages of more resistant materials, such as metals (for example an aluminum sheet).

In any case, reference will be made in the following to complete packages, to which the device of the invention is applied: that is, said device is not an essential element for the full definition of the package/wrapping, which hence enjoys independent life regardless of the provision of the device of the invention.

Figure 1A:
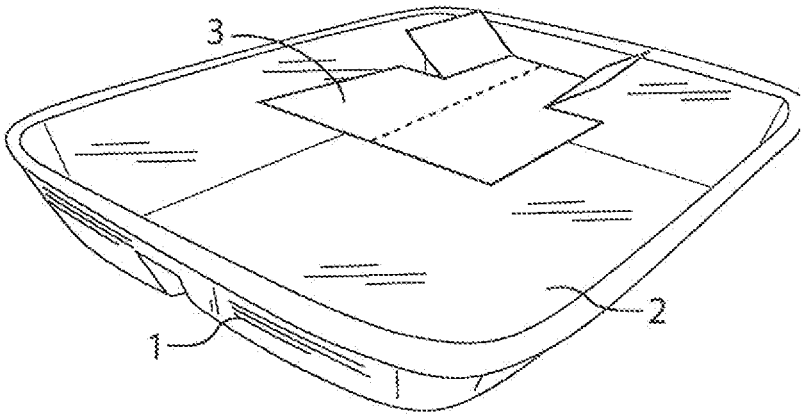
FIGS. 1*a*-1*c* are perspective views of an exemplifying package, closed with a stretching film, provided with a device according to the invention in three subsequent steps of use.
Figure 1B:
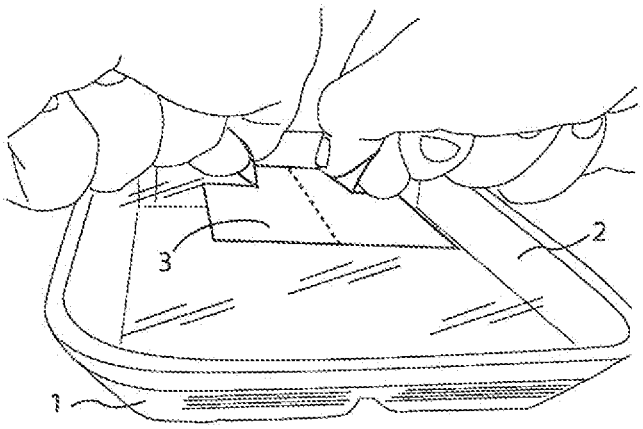
Figure 1C:
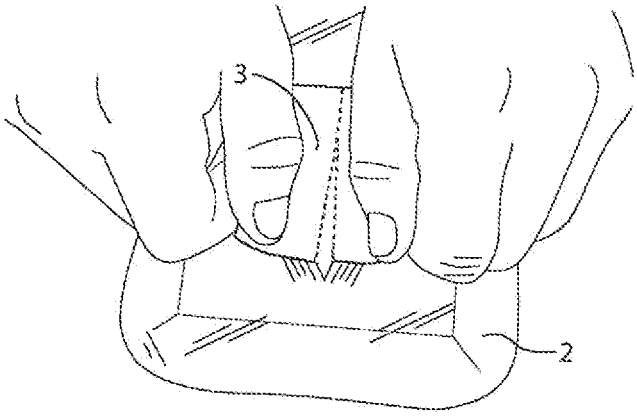

FIGS. 1*a*-1*c* refer to a package which consists—in a manner known per se—of a lower container 1, for example a foamed—polystyrene tray—and of a thin plastic film 2, for example made of stretchable material, applied above lower container 1, as a closure.

Plastic film or membrane 2 is applied well taut to the lower container and encloses inside a product to be purchased, for example a fresh food product.

Once the package has been sealed in a conventional way, on the outer surface of plastic membrane 2 a tearing device in the shape of an adhesive label 3 is applied, which finally act also as a gripping point and tearing guide.

In particular, the tearing device according to a first embodiment of the invention consists of an adhesive label 3, comprising a base layer of the label, made at least partly adhesive on a lower side and configured so as to define at least one gripping portion and a stress-concentration and deformation-concentration area.

On the upper or outer surface, the base layer of the label may be printed on and hence display, like a standard label, information of a various nature. The lower surface is made adhesive (through a gluing agent, but also with other means), so as to create a solid joining with the underlying package material, for example plastic membrane 2 or another portion of material of the package to be torn.

The base layer of the device (label) may be made of various materials (for example paper, plastics, . . . or in any case the ones typically used for the manufacture of labels) and thicknesses, provided it has a tension resistance exceeding the one of the underlying package. It is furthermore important that the elasticity or tension elongation As a matter of fact, according to the invention, the mechanism which eases the tearing of the sheath is based on the fact that the adhesive label is capable of transferring in a substantially rigid way—or in any case with a very low relative elongation—the stress applied by the fingers of one's hand to two mutually very close points, between which a distance as short as possible may be defined, so that the underlying (extremely ductile) material of the package be brought to rupture through a displacement (deformation) of the gripping points as limited as possible.

In other words, while the fingers of one's hand are capable of imparting a tension between two points of the adhesive label mutually spaced apart by a distance $L>>0$ (for example 5 mm), the label (due to the far higher rigidity thereof than that of the sheath which it is meant to tear) is capable of transferring the stress to two points of the label (in the proximity of a preset-rupture line, as will be shown further on) which are mutually extremely close, by a distance $L_0 \sim 0$.

An essential feature for the purpose of the teaching of the invention is hence that the adhesive device provides a stress localisation line and concentration line, that is, a position to which the stresses applied to the device are transferred and where a singular yielding of the device is found, so that the tearing stress may discharge completely on the underlying wrapping of the package.

According to a first embodiment of the invention, the base layer of label 3 has at least a terminal portion devoid of adhesive or in any case not adhesive, which hence remains detached or easily detachable from the wall of the package to which it is applied.

This non-adhesive portion, as can be seen further on, is not strictly needed provided, but it is advantageous and preferred for contributing to the ease of handling of the device. The non-adhesive portion of the base layer is of such a size as to be able to be gripped easily with the fingers of one's hand, partly raised from the package and acting as grip for imparting the tearing stress more easily.

The device is configured so as to determine at least two points of localised application of the stress, or a mutually very close point of application of the stress and a point of reaction to the stress: that implies, as indicated above, that the deformation consequent to the stress propagates on a very short distance $L_0$ (of the order of some tenths of millimetre at most) and hence allows to produce a tearing in a very effective and direct way even in the case of highly stretchable materials. In the context of this description, the definition of "very short" distance $L_0$ or of "mutually very close" points hence implies a distance of a few tenths of millimetre and in any case below a millimetre.

The invention can hence be embodied in various ways and embodiments, always comprising at least one precut line or a weakening line between two adjacent portions of base layer, which makes up a concentration line of the stresses on the underlying package wrapping, hence a predetermined tearing line.

Figure 2:
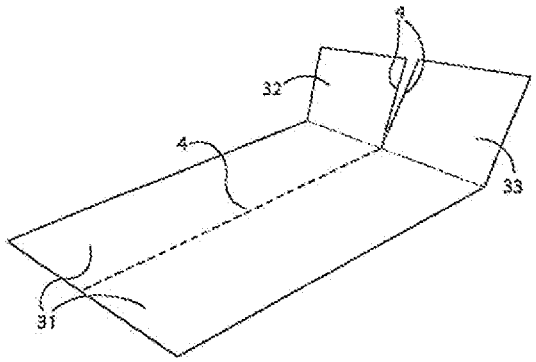
FIG. 2 is a perspective view of an adhesive label according to a variant.

FIG. 2 shows the first embodiment, wherein label 3 has an adhesive portion 31 from which two mutually separate, non-adhesive, adjacent portions 32 and 33 project. Moreover, a precut line 4, or in any case a preferred-tearing line 4 is provided, which extends longitudinally across the entire adhesive portion 31, starting from the point of contact of the two non-adhesive portions 32 and 33.

Preferably, as illustrated, precut line 4 is in the shape of an incision or half-incision groove (FIG. 10B) or of full-incision portions alternated with non-precut portions (FIG. 10A), at least for a substantial extension of the base layer of the label. The precut line, in substance, defines a weakening line of the base layer, of an infinitesimal width $L_0$, where the tension stresses of the fingers are transferred and localised and where the rupture load is hence quickly achieved with reduced absolute elongations. Accordingly, the precut line could be also an actual cut of an infinitesimal width (that is of a few tenths of a millimetre), such as to separate the label into two parts: in order to avoid problems of application of the two completely separate parts (which should nevertheless be applied very close to each other) two or more connecting bridges could at most be left.

As illustrated in FIG. 2, along a remaining extension of label, smaller for example than half the label length and for example coinciding with the sole non-adhesive portion, precut line 4 is in the shape of a full cut 4*a*. In such case, as mentioned, full cut 4*a* divides the terminal, non-adhesive label portion into two tabs or flaps 32 and 33.

As mentioned, base label layer 3, 31 is typically made of paper or other sufficiently resistant (such as more resistant than the wrapping material) and little-elastic material, according to what has been stated above. The base layer can thus be flexible, but also substantially rigid: in this second case, it is possible to impart to the sheath also forces with a lever effect.

In order to locally strengthen the device in the proximity of the precut area, and to avoid that it may tear crosswise to said precut line, it can be provided to reinforce base layer 3, 31 with a small longitudinal strip (arranged adjacent to the precut line) of stronger material, for example a thin thread of metal or plastic material.

The outer surface of device 3, 31 is preferably designed so as to be able to print thereon information and data useful for the identification of the package contents, so that the label according to the invention may possibly fully replace conventional price labels. The information is preferably distributed on the two sides of precut line 4, so that, subsequently to the separation of the two label parts, such information remains readable. An example of label reporting data useful for fully replacing price labels is illustrated in FIG. 9.

Figure 3:
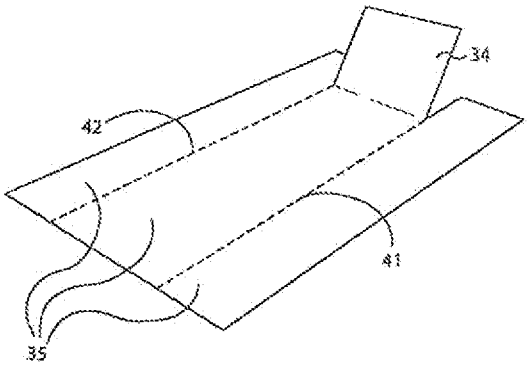
FIG. 3 is a perspective view of an adhesive label according to another variant.

FIG. 3 shows another embodiment, wherein a single non-adhesive portion or tab 34 and two precut lines 41 and 42 are provided which extend parallel and longitudinally to the label starting from the two joining points of tab 34 with the adhesive portion 35 of the label.

Weakening lines 41 and 42 may also extend on a shorter length than that of the adhesive portion of the label. In such case, the label according to the invention would determine a sort of cut-out of a preset size in the sheath, since the tearing would end in correspondence of the end of the weakening lines. For such purpose it is also possible to provide tearing-stop means, for example a thread of strong material embedded in the material of the base layer in a direction orthogonal to the weakening lines.

Figure 4:
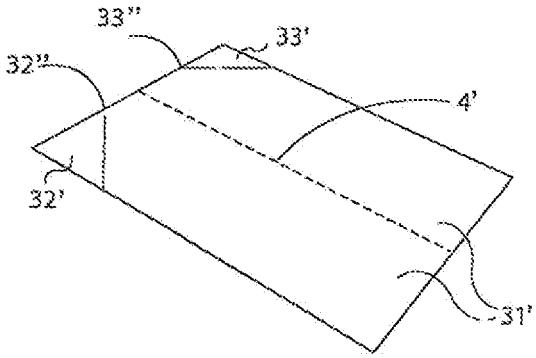
FIG. 4 is a perspective view of an embodiment of the invention.

FIG. 4 shows a preferred embodiment of the device according to the invention. This label is very similar to the one of FIG. 2. In such case, however, the two non-adhesive tabs 32' and 33' do not have a joining point on precut line 4'. While in the embodiment of FIG. 2 the border line between adhesive area 31 and non-adhesive tabs 32 and 33 is substantially orthogonal to precut line 4, in the embodiment of FIG. 4 the border lines are oblique and do not cross on the label.

The two non-adhesive portions 32' and 33' making up gripping tabs are arranged on the two opposite sides of the adhesive portion 31 of label 3, spaced apart from precut line 4' which makes up the predefined tearing line. In particular, two border lines 32" and 33" are defined, respectively, between tab 32' and 33' and adhesive portion 31, which are arranged obliquely and not crossing precut line 4.

This embodiment is particularly advantageous since the stress application point (that is, border lines 32" and 33" between the non-adhesive tabs and the adhesive portion) lies at a certain distance from the expected tearing point: that leads the user to impart a traction along a small angle with respect to the package surface, typically an angle below 20° and ideally tangential to the package surface (which makes up also the coupling surface between the wrapping and the adhesive device). Thereby, the adhesive film arranged between the base layer of label 3 and the wrapping is not stressed in a limited area (as occurs instead in the prior art), but on a very wide area arranged between the point of application of the stress and the expected tearing point.

In other words, when a non-adhesive portion is provided in the form of a tab, typically a border line arises between the non-adhesive tab and the adhesive portion joined to the wrapping: it is preferable for this border line to lie at a certain distance from the expected tearing position, for example at least 1 mm. Even more preferably, said border line has an angle greater than 45° to an expected tearing line, even more preferably an angle of 90°. This arrangement ensures that the user is naturally led to impart a traction which does not cause a "peeling" of the label with respect to the wrapping, but is instead directed with an angle as close as possible to the tangent line to the outer surface of the wrapping, so as to exploit at best the adhesive capacity of the adhesive and transfer on the package a high and concentrated tearing stress along weakening line 4, 4'.

Figure 5:
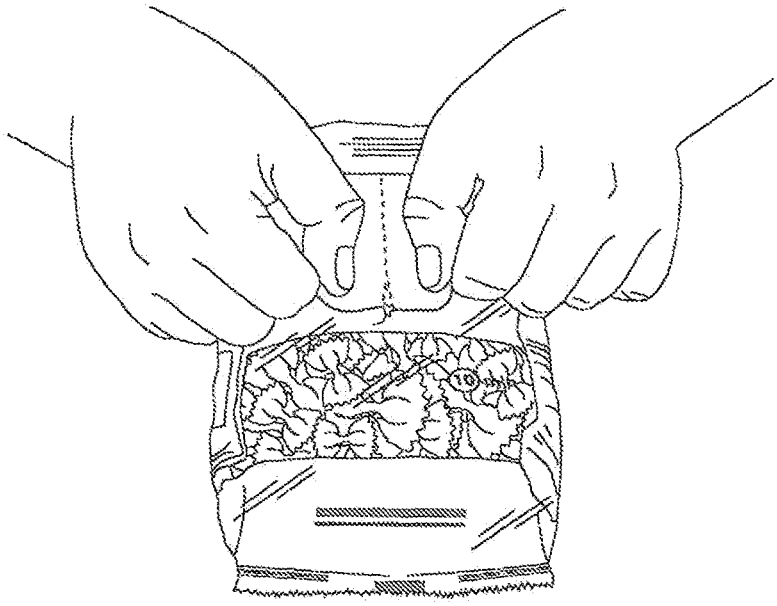
FIG. 5 is a perspective view of another exemplifying package, in the shape of a bag, provided with a device according to the invention.

The solution of FIG. 4 also has the advantage of reducing a possible raising effect of tabs 32' and 33' during a label application or printing step. As a matter of fact, the direction of advancement of the label—during label manufacture, printing or arrangement on the package—typically matches the longitudinal axis and precut line 4 or 4': if the non-adhesive tabs are constrained to base layer 31 and 31' according to a line perpendicular to the direction of advancement (as in FIG. 2), they are subject to being raised and may hence cause jamming. The version of FIG. 4 is preferable to avoid jamming. FIG. 5 shows a package in the form of an envelope, for example for biscuits or snacks, of plastic material. Thereon a label according to the invention is applied.

Figure 7:
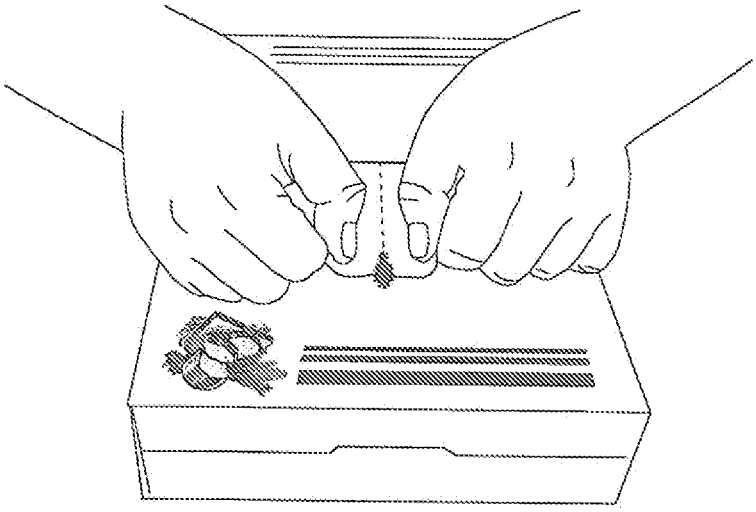
FIG. 7 is a perspective view of another exemplifying package, in the shape of a box, provided with a device according to the invention.
Figure 8A:
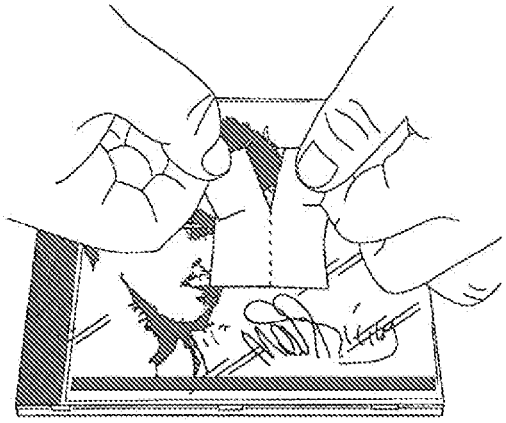
FIGS. 8A and 8B are perspective views of further exemplifying packages, in the shape of a plastic-film sheath around a CD and around a book, respectively, provided with a device according to the invention.
Figure 8B:
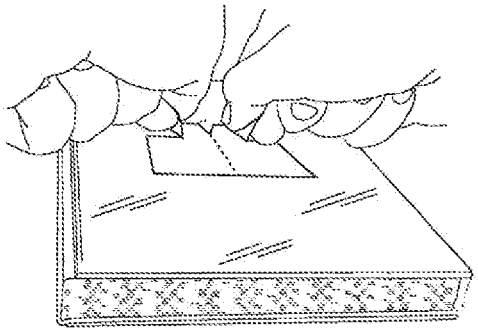
Figure 8C:
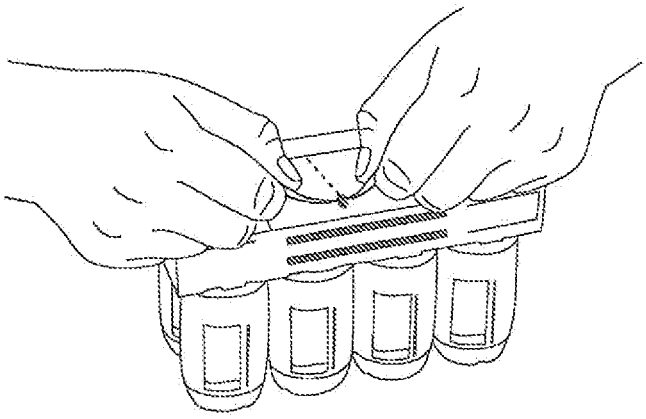
FIG. 8C is a perspective view of a further secondary package onto which the device of the invention is applied.

FIG. 7 shows a similar condition to that of FIG. 5, in which, however, the package is a sufficiently rigid box, for example a pasta or sugar cardboard box. In this case, too, without having to change the box shape or assembling procedure, the opening may be easily obtained by the user through a label according to the invention applied externally to a surface of the box. FIGS. 8A and 8B other two typical examples, in which the conventional opening of the package is difficult. It is a packaging with thin plastic (sometimes heat-shrinking) film around flat objects, such as a book or a CD/DVD. It is common experience that the opening of these packages is very difficult if one has no sharp tool or suitable tearing tab integrated in the package. By the application of the label according to the invention, possibly provided with the pricing data, it is instead allowed to achieve an easy opening through film tearing.

FIG. 9, as mentioned, represents an exemplifying label, such as the one of FIG. 4, provided with a series of indications printed on the outer surface of the base layer. This type of layer may advantageously fully replace conventional adhesive labels, used for the pricing of products, providing an additional function without an appreciable cost increase.

Figure 6:
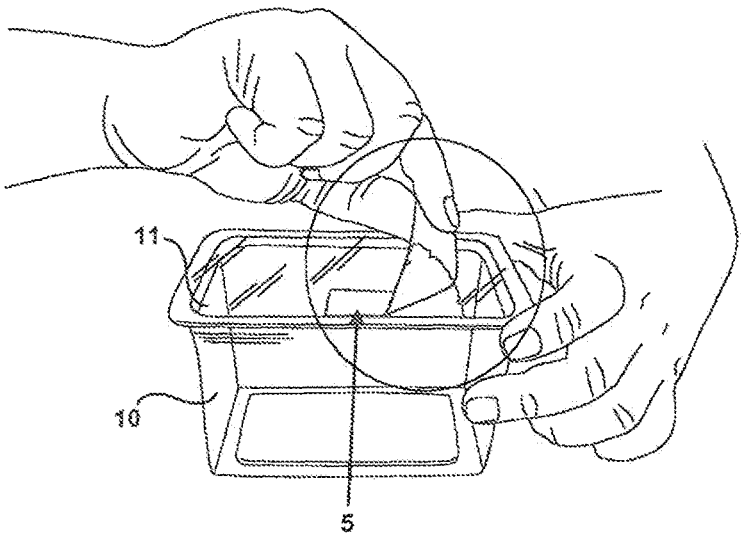
Figure 6A:
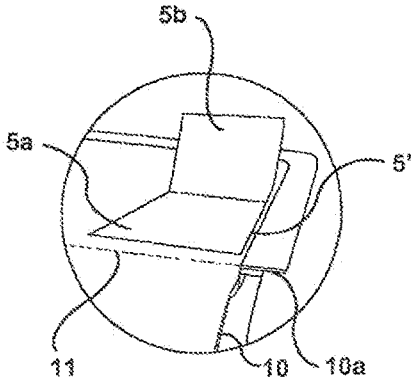
FIG. 6A is an elongated partly crossed view.

FIG. 6 shows instead an alternative tearing device. In this case, the tearing device has a resistant base layer 5 comprising an adhesive portion 5*a* and an adhesiveless portion 5*b*, in the form of liftable tab. The configuration of this label does not need the presence of a precut or weakening line to ease tearing, since such weakening line is determined by the specific positioning of the adhesive label. As a matter of fact, at least adhesive portion 5*a* has a rectilinear or suitably shaped lateral edge 5' to be arranged closely adjacent to a welding rim of the package, that is, a substantially rigid portion of the package. As can be seen in FIGS. 6 and 6A, the tearing device according to this embodiment is arranged along the edge of a heat-welded tray, that is, a substantially rigid tray 10 which has a closing film 11 bonded (with adhesive or by melting, for example) to the mouth edge 10*a* thereof. Plastic film 11 is hence fastened to a substantially rigid edge 10*a*, which is capable of opposing a certain resistance, that is, of imparting a counter-reaction, to a stress applied to film 11. Arranging the tearing device very close to rigid edge 10*a*, a long and very narrow (of the order of a few tenths of millimetre) area of film is determined between label 5 and edge 10*a*, which may reach the yielding and rupture limit through a modest stress applied through label 5. In this case, therefore, it is enough to act on tab 5*b* to impart a tension which concentrates the effort thereof in the area between portion 5*a* and rigid edge 10*a*, determining an effective tearing of film 11.

In substance, to obtain the stress localisation effect, the presence of a rigid member of the package is exploited, which may act with a counter-reaction on the closing film, to replace the function of either one of the two label portions. In other words, the stress concentration effect is achieved between an adhesive-label portion integral with the adhesive-less gripping tab and a rigid member of the package (arranged in close proximity, that is, very close to each other), between which a narrow (infinitesimal, in theory) film connection remains, instead of two gripping tabs which act on the opposite sides of a precut line. In the worst-case scenario, should film 11 be too resistant, it would tend to become detached from the rigid edge of the package, overcoming the adhesion of the peripheral welding rim, thus opening the package.

The device according to the invention operates as follows.

Figure 11:
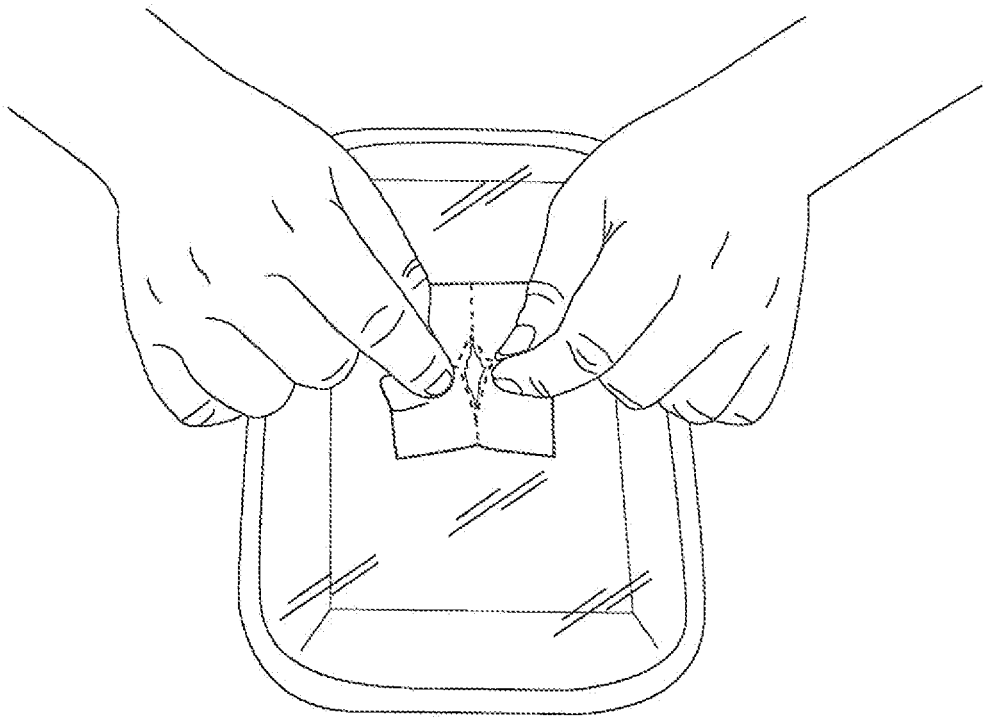
FIG. 11 is a perspective view of a different label applied to a package.

The label-shaped device is printed, in a way known per se, with the relevant information and applied to the film or sheath of a package, causing the adhesive portion to adhere. Any non-adhesive flap(s) remains detached from the plastic film and can hence be easily lifted and gripped with the fingers of one's hand. With the embodiment of FIG. 2, the two flaps 32 and 33 are pulled, moving them away from each other according to a direction having a small angle to the coupling surface between label 3 and the wrapping, and a tearing stress localised along precut line 4 is caused. The stress propagates across the entire adhesive portion 31 defined between the border lines and the precut line, discharging on a wide surface and hence without impairing the adhesive capability of the label. The base layer of the label easily tends to open into two, along the longitudinal axis coinciding with precut line 4, 4', 41, 42, transferring the tearing stress to the underlying package film or wall, due to the strong adhesion existing on the entire adhesive surface of the label, and to the consequent deformation located on infinitesimal width $L_0$. A simple tearing also of the film or package wall is thus obtained, without having to resort to any cutting tool. FIG. 11 shows a simplified embodiment. According to a variant not shown, the device according to the invention may further cooperate with tearing facilitated-trigger means. For example, the facilitated-trigger means are in the form of weakening portions obtained on the sheath to be torn, in a position below the adhesive label: a small hole or notch in the package wall, preferably in correspondence of the stress concentration area of the device of the invention, for example under the precut line or in correspondence of the joining area between adhesive portion and non-adhesive portion. The facilitated-trigger means may be obtained with mechanical or chemical systems. For example, during the application of the adhesive label, the same/very applicator may (mechanically) cause one or more microholes in the plastic film of the package, or weakening micro-cavities which do not entirely run through the wrapping sheath. The microholes or micro-cavities may be obtained through a mechanical punch either directly on the package or through a hot tip which locally heats the plastic film of the package. The presence of the adhesive label keeps the steady area around the microholes or other local weakening portions, so as not to impair even the sealing of the package; however, when the tearing stress is imparted, the presence of the weakening portions of the sheath eases the trigger and propagation of the tearing in the package.

Alternatively, on the adhesive side of the label a drop of a (liquid, gel, or other) solvent suited to partly and locally melt the film of the package may be arranged: during the label adhesion to the package, the solvent acts on the film and (chemically) determines weakening (simple local thickness reductions or micro-throughcracks) suited to ease the subsequent tearing. The solvent may be applied directly on the wrapping during label application, or it may be embedded on the adhesive side of the label for subsequent release.

Figure 12:
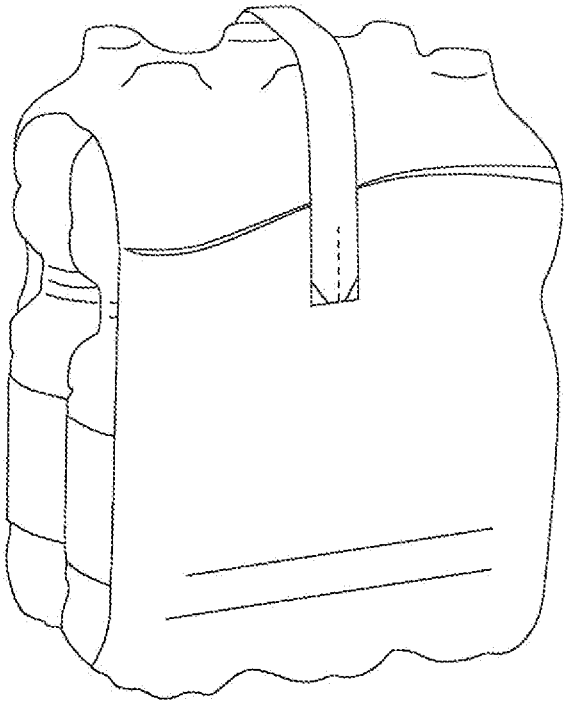
FIGS. 12 and 13 are schematic, perspective views of another embodiment of the invention applied to a bundle for bottles, in two steps of use.

FIG. 12 shows a further embodiment of the invention, in which the tearing device is part of and integrated in another functional member of the wrapping. In particular, FIG. 12 shows a bundle of bottles consisting of a series of primary wrappings (the plastic bottles) consolidated in a plastic film sheath (typically heat-shrinking) which makes up the secondary wrapping. On the plastic film sheath of the bundle a handle/grip is applied, itself typically in the shape of a ribbon of plastic material coupled with a paper sheet. The handle ribbon is glued or otherwise welded to the sheath surface of the secondary wrapping. At least one of the ribbon ends of the handle makes up the device according to the invention, that is, it has a weakening line which eases the tearing thereof and that of the underlying plastic film, according to the teachings provided here. Given the tenacity typical of the heat-shrinking sheaths for bundles, here it is particularly suited to provide also the facilitated-trigger means described in the previous paragraph.

Figure 13:
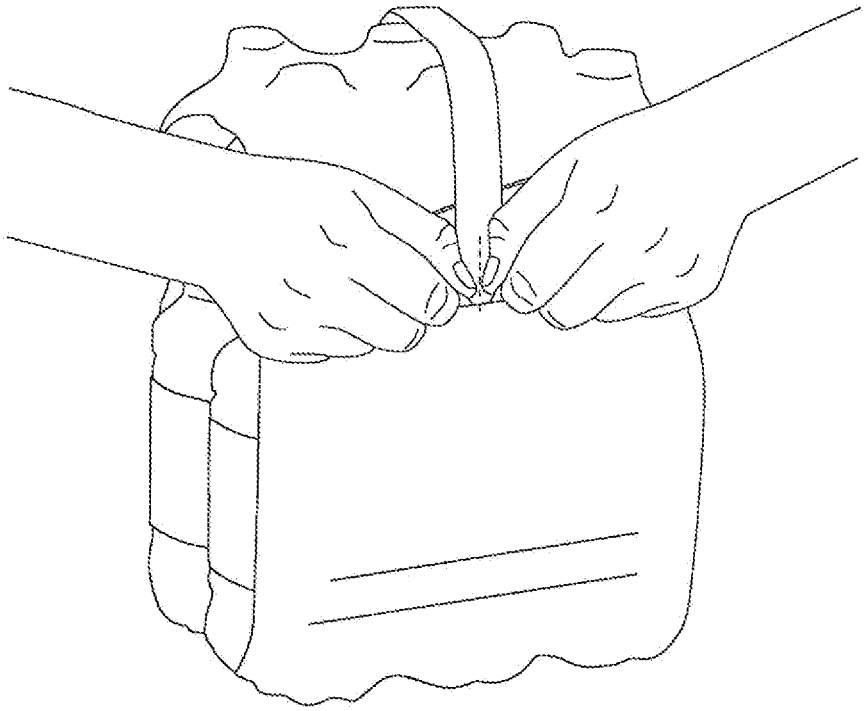

FIGS. 12 and 13 show that the end of the handle ribbon has two tabs which are not strictly adhering to the secondary wrapping, so as to ease gripping by the fingers of one's hand (FIG. 13).

Figure 14:
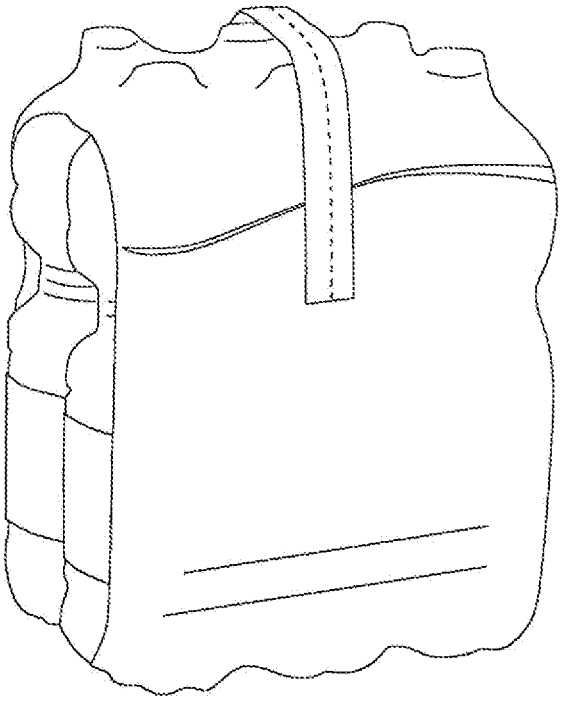
FIGS. 14 and 15 are views similar to FIGS. 12 and 13 of a further version of adhesive label applied to a bundle for bottles.
Figure 15:
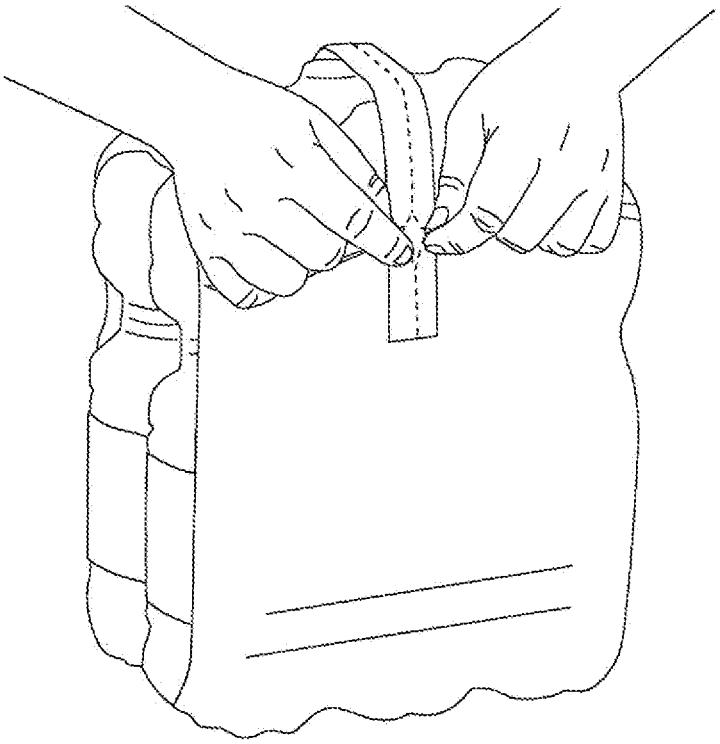
Figure 16:
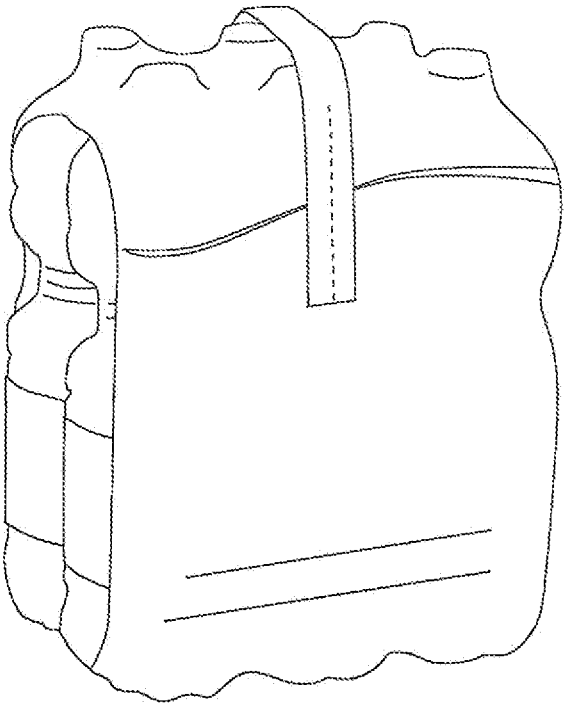
FIGS. 16 and 17 are similar views to FIGS. 12 and 13 of still another version of an adhesive label applied to a bundle for bottles.
Figure 17:
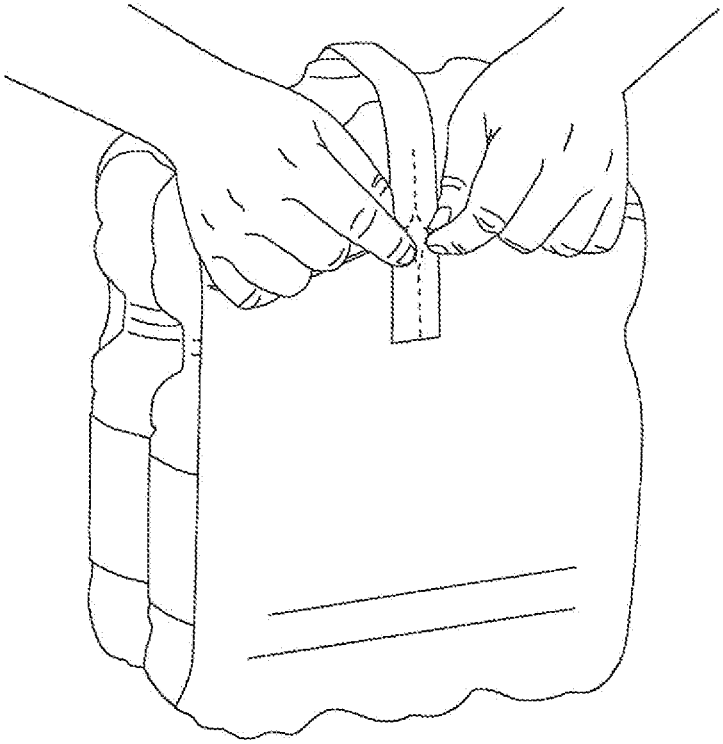

A variant to this embodiment may provide that the weakening line be provided along the entire handle ribbon (FIGS. 14 e 15) or on a different extension thereof (FIGS. 16 and 17).

As can be understood from the detailed description reported above, the device according to the invention perfectly accomplishes the objects set forth in the premises. As a matter of fact, the device is extremely inexpensive and simple, despite achieving a significant effectiveness with respect to the tearing function thereof.

The tearing device possibly provided with two different portions, of which only one adhesive, as well as with a possible easy-rupture weakening line, may be manufactured with standard dimensions, so as to be able to be used also in conventional machines for printing and for the application of pricing labels, thereby making itself usable without changing in any way the existing packaging procedures.

The tearing device of the invention may be applied, without interfering with the manufacturing process, on multiple types of packages, of plastic, paper or even metal (thin sheets) material.

The tearing device may also be integrated in other functional members (for example the handle of a bundle) to be applied to the package/wrapping once completed and closed.

However, it is understood that the invention must not be considered limited to the special embodiments illustrated above, which are to be considered exemplifying and non-limiting, since different variants are possible, all within the reach of a person skilled in the field, without departing from the scope of protection of the invention, as defined by the following claims.

In particular, should it not be useful to print information relating to the package contents, the outer surface of the base layer may bear a trademark of the package manufacturer or a distinctive mark which identifies the specific tearing device and the destination thereof. Preferably, a visual indication is shown on the label which illustrates to the user the best way of operation, that is, which leads the user to impart a traction according to a direction as tangent as possible to the wrapping surface, so as to avoid that the label be lifted perpendicularly to the wrapping surface, which would produce an undesired "peeling" effect.

Furthermore, it must be considered that, where it has been stated that the flaps are of a "non-adhesive" type, it is meant that they are fully devoid of adhesive, or they are provided with a low-tack adhesive (for example removable adhesive). That nevertheless allows to easily detach the gripping flaps from the plastic film of the package, but prevents the two flaps from lifting independently, which in some automatic packaging processes might cause problems to the perfect finish of the package.

Moreover, it must be highlighted that the resistant bonding of the adhesive portion to the package may be obtained in different ways, depending on the package materials, but not necessarily with a glue. The bonding of the adhesive portion with the package wall may occur also by welding (hot welding, ultrasound welding, friction welding, . . . ) or by mechanical fastening means, such as small rivets. The fastening points of the adhesive portion to the package may themselves represent weakening points (hence preferred rupture line) of the base layer of the device. It suffices to imagine, in that respect, a series of small hot incisions, practised on a base layer of plastic material applied to a plastic package: hot incisions determine at the same time facilitated rupture points and welding points between the base layer of the device and the underlying plastic film of the package and perhaps even facilitated-trigger means in the package.

Finally, it is not ruled out to be able to provide resealable means integral with the base layer of the device. For example, a further low-tack label may be applied crosswise to the preferred-breakage line to be able to provisionally reseal the package after having locally torn it.

What is claimed is:

1. Assembly of a package wrapping sheath with a tearing device applied to any position of a complete sealed package (1, 2) made with said wrapping sheath, said tearing device comprising:

an adhesive label having a base layer (3) provided with a first adhesive portion (31, 35, 31') and at least a second non-adhesive, terminal portion (32, 33, 34, 32', 33'), the second non-adhesive, terminal portion acting as gripping flap for imparting a manual traction;

wherein the adhesive label is so arranged as to determine at least two points of localized application of the stress, or a point of stress application and a point of reaction to the stress, at a distance of a few tenths of a millimeter to below a millimeter to each other on said wrapping sheath, upon applying a traction on said at least one, non-adhesive, terminal portion;

wherein at least one longitudinal weakening line or preferred-rupture line (4, 41, 4') is furthermore provided on the tearing device which crosses at least in part said first portion of the base layer;

wherein said base layer is made of a material having an ultimate tensile strength higher than that of said wrapping sheath and a much lower tensile elongation that that of said wrapping sheath; and wherein the package includes a thin plastic film made of a stretchable material applied to close the package.

2. The assembly as claimed in claim 1, wherein said second, non-adhesive terminal portion is arranged so as to define a pair of border line (32", 33"), with said first adhesive portion at least partly spaced apart from an intended tearing location, so as to cause a tearing traction according to an angle below twenty degrees and ideally tangential to the package surface to the adhesion surface between said package sheath and said first adhesive portion (31).

3. The assembly as claimed in claim 2, wherein two non-adhesive terminal portions (32", 33"), separated and connected to the same first adhesive portion (31) are provided.

4. The assembly as claimed in claim 3, wherein the pair of border lines (32", 33") between said two non-adhesive, terminal portions and said first adhesive portion do not intercept said weakening line or preferred rupture line (4').

5. The assembly as claimed in claim 1, wherein said weakening line (4, 4') is in the shape of a half incised groove or of a plurality of fully incised lengths alternated with non-incised lengths.

6. Device as claimed in claim 1, when applied to a thin film in a position very close to a rigid portion of a package sealed by said thin film.

7. Device as claimed in claim 1, cooperating with facilitated-trigger means which affect the integrity of the wrapping sheath underneath the adhesive base layer.

8. Device as claimed in claim 7, wherein said facilitated-trigger means are of a chemical type suitable to the at least partial melting of the package sheath.

9. The assembly as claimed in claim 1, wherein on an outer side of said base layer pricing and/or labelling data are printed.

10. Device as claimed in claim 1, characterized in that it is integrated in a terminal edge of a ribbon handle joined to a plastic film of a bottle bundle.

11. Package comprising at least a closing wrapping sheath, characterized in that on the outer surface of said wrapping sheath a tearing device is applied as claimed in claim 1.

12. A method of opening a complete sealed package (1, 2) made with a wrapping sheath of claim 1, comprising the steps of:

applying a tearing device to any position of said wrapping sheath of the complete sealed package, said tearing device consisting of an adhesive label having a base layer (3) provided with a first adhesive portion (31, 35, 31') and at least a second non-adhesive, terminal portion (32, 33, 34, 32', 33'), the second non-adhesive, terminal portion acting as gripping flap for imparting a manual traction, wherein said label is so arranged as to provide at least two points of localized application of the stress, or a point of stress application and a point of reaction to the stress, very close to each other; and applying upon on said wrapping sheath a traction on said at least one, non-adhesive, terminal portion, and wherein at least one longitudinal weakening line or preferred-rupture line (4, 41, 4') is furthermore provided on the tearing device which crosses at least in part said first portion of the base layer.

* * * * *